US008118904B2

(12) United States Patent
Watanabe

(10) Patent No.: US 8,118,904 B2
(45) Date of Patent: Feb. 21, 2012

(54) METAL POWDER MANUFACTURING DEVICE, METAL POWDER, AND MOLDED BODY

(75) Inventor: Atsushi Watanabe, Hachinohe (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/197,105

(22) Filed: Aug. 3, 2011

(65) Prior Publication Data

US 2011/0283835 A1 Nov. 24, 2011

Related U.S. Application Data

(62) Division of application No. 11/693,115, filed on Mar. 29, 2007, now Pat. No. 8,012,408.

(30) Foreign Application Priority Data

Apr. 25, 2006 (JP) ..... 2006-121279

(51) Int. Cl.
*C21C 1/00* (2006.01)

(52) U.S. Cl. ..... 75/337; 75/331

(58) Field of Classification Search ..... 75/331, 75/337, 338, 340, 341
See application file for complete search history.

(56) References Cited

U.S. PATENT DOCUMENTS 4,647,305 A 3/1987 Kumai et al.
5,320,509 A 6/1994 Oka
6,254,661 B1 7/2001 Takeda
7,118,052 B2 10/2006 Zhou
8,012,408 B2 * 9/2011 Watanabe ..... 75/331
2006/0147570 A1 7/2006 Nakai et al.

FOREIGN PATENT DOCUMENTS

| | | |
|---|---|---|
| JP | 60-24302 | 2/1985 |
| JP | 60-24303 | 2/1985 |
| JP | 61-204305 | 9/1986 |
| JP | 64-015306 | 1/1989 |
| JP | 03-232907 | 10/1991 |
| JP | 03-232908 | 10/1991 |
| JP | 11-214210 | 8/1999 |
| JP | 2004-107740 | 4/2004 |
| KR | 2005-0109479 | 11/2005 |
| WO | 99/11407 | 3/1999 |

* cited by examiner

*Primary Examiner* — Scott Kastler
(74) *Attorney, Agent, or Firm* — Harness, Dickey & Pierce, P.L.C.

(57) ABSTRACT

A metal powder manufacturing device for manufacturing a metal powder includes a feed for supplying a molten metal, a fluid spout unit, and a course modification unit. The fluid spout unit further includes a channel and an orifice. The channel is provided below the feed, allowing passing of the molten metal supplied from the feed. The orifice is opened at a bottom end of the channel, spouting a fluid into the channel. The above course modification unit is provided below the fluid spout unit, and forcibly changes the traveling direction of a dispersion liquid. This dispersion liquid is composed of multiple fine droplets dispersed into the fluid. The above droplets are a resultant of a breakup caused by a contact between the molten metal and the fluid ejected from the orifice. Here, the dispersion liquid is transported so that the droplets is cooled and solidified in the dispersion liquid in order to manufacture the metal powder.

10 Claims, 7 Drawing Sheets

METAL POWDER MANUFACTURING DEVICE, METAL POWDER, AND MOLDED BODY

CROSS-REFERENCE TO RELATED APPLICATIONS

This is a divisional application of U.S. Ser. No. 11/693,115 filed Mar. 29, 2007 now U.S. Pat. No. 8,012,408, which claims priority to Japanese Patent Application No. 2006-121279 filed Apr. 25, 2006 all of which are expressly incorporated by reference herein in their entireties.

BACKGROUND

1. Technical Field

The present invention relates to a metal powder manufacturing device, a metal powder, and a molded body.

2. Related Art

In order to manufacture metal powder, the water atomizing method is known, with which molten metal is made into powder. WO99/11407 is an example of this related art.

This method causes molten metal to pass through a channel provided in the center of a fluid spout unit. During the passing, the molten metal contacts the water ejected into the channel, and thereby breaks up, cools down, and solidifies. Consequently, the metal powder is manufactured.

A method for obtaining amorphous metal powder is disclosed, with which a molten metal is rapidly cooled down using the above method, retaining the disorder of the atomic positions (refer to JP-A-H11-214210 as an example).

Such water atomizing causes a generation of water vapor, as the molten metal contacts water and settles. This water vapor is generated, surrounding the metal when the metal settles. The water film has lower thermal conductivity compared to water, and thus inhibits rapid cooling of droplets. As a result, droplets of a certain size are not cooled down to the core rapidly enough, making it difficult to maintain an amorphous state of the droplets. Consequently, it involves a problem that a crystallized metal powder is obtained instead.

SUMMARY

An advantage of the invention is to provide a metal powder manufacturing device which allows an efficient manufacturing of amorphous metal powder containing larger particles, as well as to provide metal powder manufactured by such a device and a molded body formed by molding such metal powder.

The advantage of the invention is achieved by the following aspects of the invention.

According to a first advantage of the invention, a metal powder manufacturing device for manufacturing metal powder includes a feed for supplying a molten metal, a fluid spout unit, and a course modification unit. The fluid spout unit further includes a channel and an orifice. The channel is provided below the feed, allowing passing of the molten metal supplied from the feed. The orifice is opened at a bottom end of the channel, spouting a fluid into the channel. The above course modification unit is provided below the fluid spout unit, and forcibly changes the traveling direction of a dispersion liquid. This dispersion liquid is composed of multiple fine droplets dispersed into the fluid. The above droplets are a resultant of a breakup caused by a contact between the molten metal and the fluid ejected from the orifice. Here, the dispersion liquid is transported so that the droplets is cooled and solidified in the dispersion liquid in order to manufacture the metal powder.

Therefore, the metal powder manufacturing device is obtained, which allows a manufacturing of the amorphous metal powder with a larger particle size in an efficient manner.

It is preferable that the course modification unit include a nozzle for ejecting a second fluid. It is also preferable that this unit forcibly change the traveling direction of the dispersion liquid by ejecting the second liquid from the nozzle toward the dispersion liquid, so as to cause the second liquid and the dispersion liquid to collide.

Consequently, the metal powder obtained thereby maintains the amorphous state down to the core. Here, the cooling efficiency is particularly high since the liquid jet constitutes a course modification unit. Therefore, the molten metal is solidified with nearly no atoms forming the crystalline structure. As a result, the metal powder in a highly amorphous state is obtained, practically without any fine crystalline structures contained therein.

It is preferable that the nozzle eject the second fluid, the fluid assuming a conical shape, converging downward.

This way, the liquid jet is ejected covering the entire bore of the third channel, causing the liquid jet to hit the dispersion liquid without missing, thereby reliably changing the course of the dispersion liquid. Consequently, multiple particles of primary powder are cooled down evenly, providing a chemically homogeneous amorphous state, i.e., a disorder in the positions of atoms of the metal powder being formed.

In this case, the orifice may eject the first fluid, the fluid assuming a conical shape, converging downward; and the nozzle may eject the second fluid, so that the second fluid collides with the first fluid, below a convergent point of the first fluid.

This prevents interference between the liquid jets, changing the course of the dispersion liquid rapidly and sufficiently.

In this case, the nozzle may eject the second fluid, so that the second fluid collides with the first fluid, at the vicinity of the convergent point of the first fluid.

This reduces the time during which the primary powder is covered with the vapor layer, so that the primary powder can be cooled rapidly. It is therefore possible to obtain the metal powder in a highly amorphous state.

It is preferable that an ejection pressure of the second fluid be between 5 to 20 MPa inclusive.

Consequently, the primary powder and the vapor layer are separated in a high reliability.

It is preferable that the metal powder manufacturing device according to the first aspect of the invention further includes a cylinder under the fluid spout unit. Here, the cylinder has the dispersion liquid passing therethrough, and the nozzle is opened at the inner circumferential surface of the cylinder.

This causes the dispersion liquid and the liquid jet to collide with each other inside the in the bore of the cylinder. Therefore the metal powder is recovered reliably, preventing the dissipation of the dispersion liquid to undesired places when hit by the liquid jet.

It is preferable that the course modification unit include a cylinder having a curved or bent curvature in the middle of the longitudinal direction thereof, and that the unit forcibly change the course of the dispersion liquid by causing the dispersion liquid to pass the curvature of the cylinder.

The metal powder is thereby obtained easily.

It is also preferable that the course modification unit include a cylinder having a narrow portion with a smaller radius in the middle of the longitudinal direction thereof, and that the unit forcibly change the course of the dispersion liquid by causing the dispersion liquid to pass the narrow portion of the cylinder.

As a result, even if the molten metal contains highly active elements, the oxidation of those elements can be suppressed, preventing a change in their composition. Thus, the amorphous metal powder is manufactured in a reliable manner.

In this case, the cylinder may abut a bottom surface of the fluid spout unit.

This prevents gas to flow in from the top part of the cylinder, causing the internal pressure of the third channel to decline, as a result of the effect brought by the liquid jet. Further, the pressure decline of the third channel causes a decline of the internal pressure of the first channel connected continuously to the third channel. This promotes the primary breakup in the first channel, accelerating a formation of fine particles.

It is preferable that the course modification unit include a block provided on the axis of the channel, and that the unit forcibly change a course of the dispersion liquid by causing the dispersion liquid to collide with the block.

The metal powder is thereby obtained with particular ease.

According to a second aspect of the invention, a metal powder is manufactured with the metal powder manufacturing device according to the first aspect of the invention.

Therefore, an amorphous metal powder with a larger particle size is obtained.

According to a third aspect of the invention, a metal powder is manufactured with a water atomizing method, the powder being composed of amorphous metal, having a particle size between 35 and 65 μm inclusive.

A granularity adjustment process such as classification is almost not necessary for manufacturing such metal powder. Therefore, the manufacturing cost of the amorphous metal powder is reduced, allowing to obtain the powder at a low cost.

In this case, it is preferable the metal powder have an average particle size of between 5 and 20 μm inclusive.

If the average particle size is within the above range, contained therein is the extremely small sized amorphous metal powder with a diameter of less than 10 μm. Consequently, a metal powder which allows a grinding of, for instance, a fine pattern is obtained at a low cost.

According to a fourth aspect of the invention, a molded body is composed of a material including a resin material and the metal powder according to the above aspects of the invention.

This means if the metal powder in the molded body contains magnetic metal, the molded body exhibits an improved soft magnetic property. If, for instance, the molded body is used as a powder magnetic core, losses such as a hysteresis loss and a eddy-current loss are small upon its magnetization, and a magnetic permeability is high.

BRIEF DESCRIPTION OF THE DRAWINGS

The invention will be described with reference to the accompanying drawings, wherein like numbers reference like elements.

DESCRIPTION OF EXEMPLARY EMBODIMENTS

Embodiments of the device for manufacturing a metal powder according to one aspect of the invention will now be described in detail, as well as examples of metal powders and molded bodies, with reference to the attached illustrations.

First Embodiment

A first embodiment according to the one aspect of the invention will be described.

Figure 1:
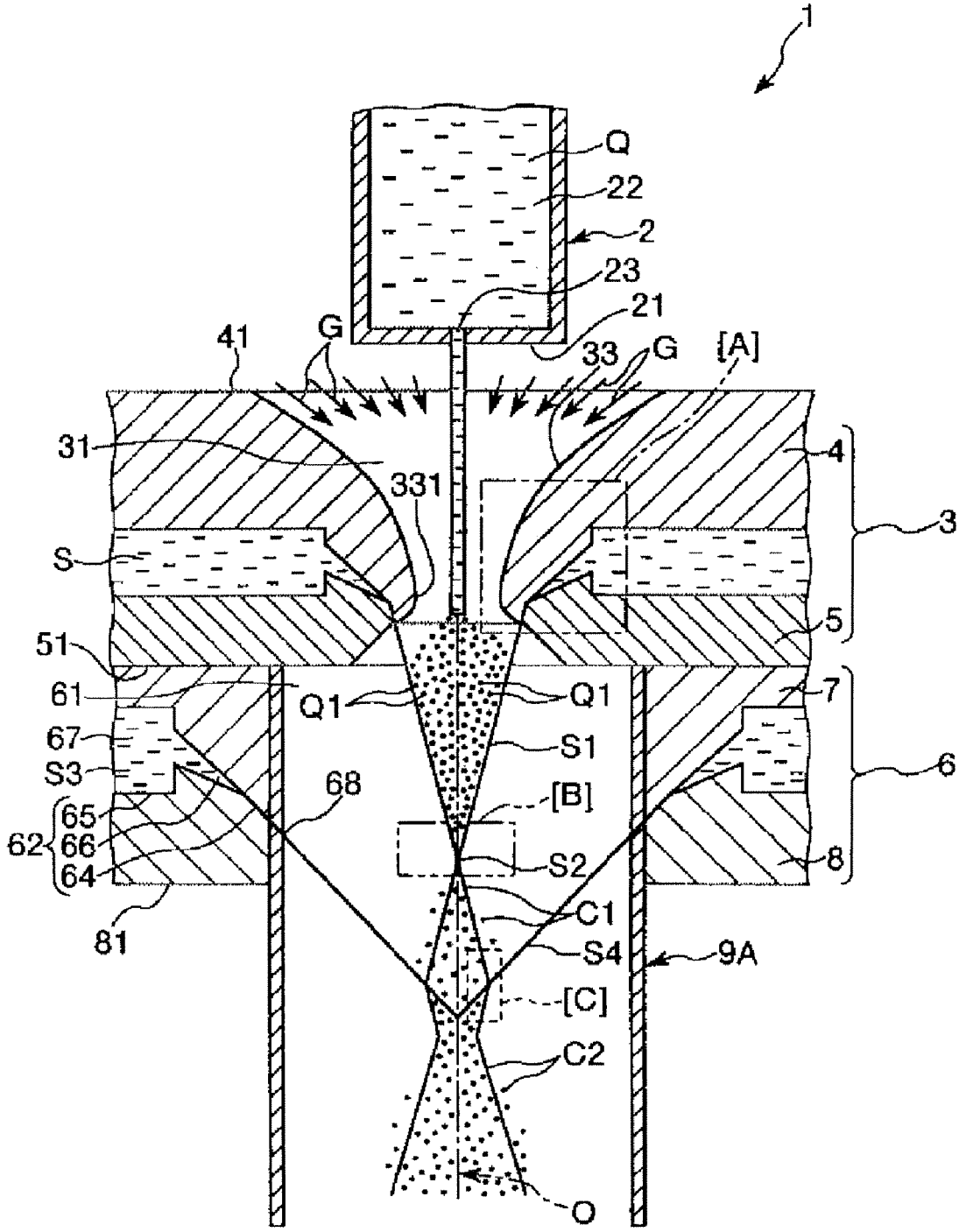
FIG. 1 is a schematic view (longitudinal sectional view) illustrating one embodiment of a device for manufacturing a metal powder according to one aspect of the invention.
Figure 2:
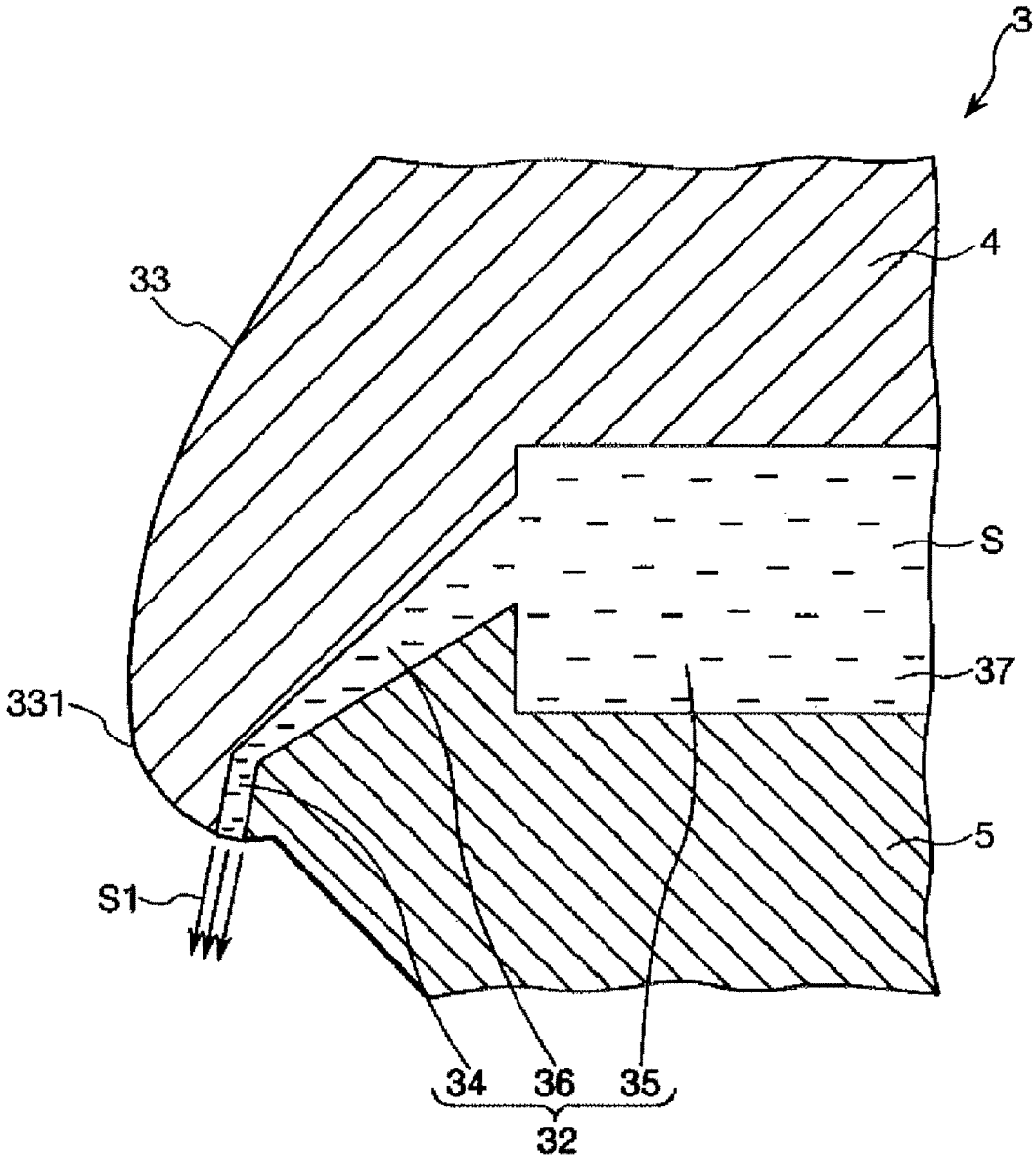
FIG. 2 is a magnified detail (schematic view) of a region A outlined with a dashed line in FIG. 1.
Figure 3:
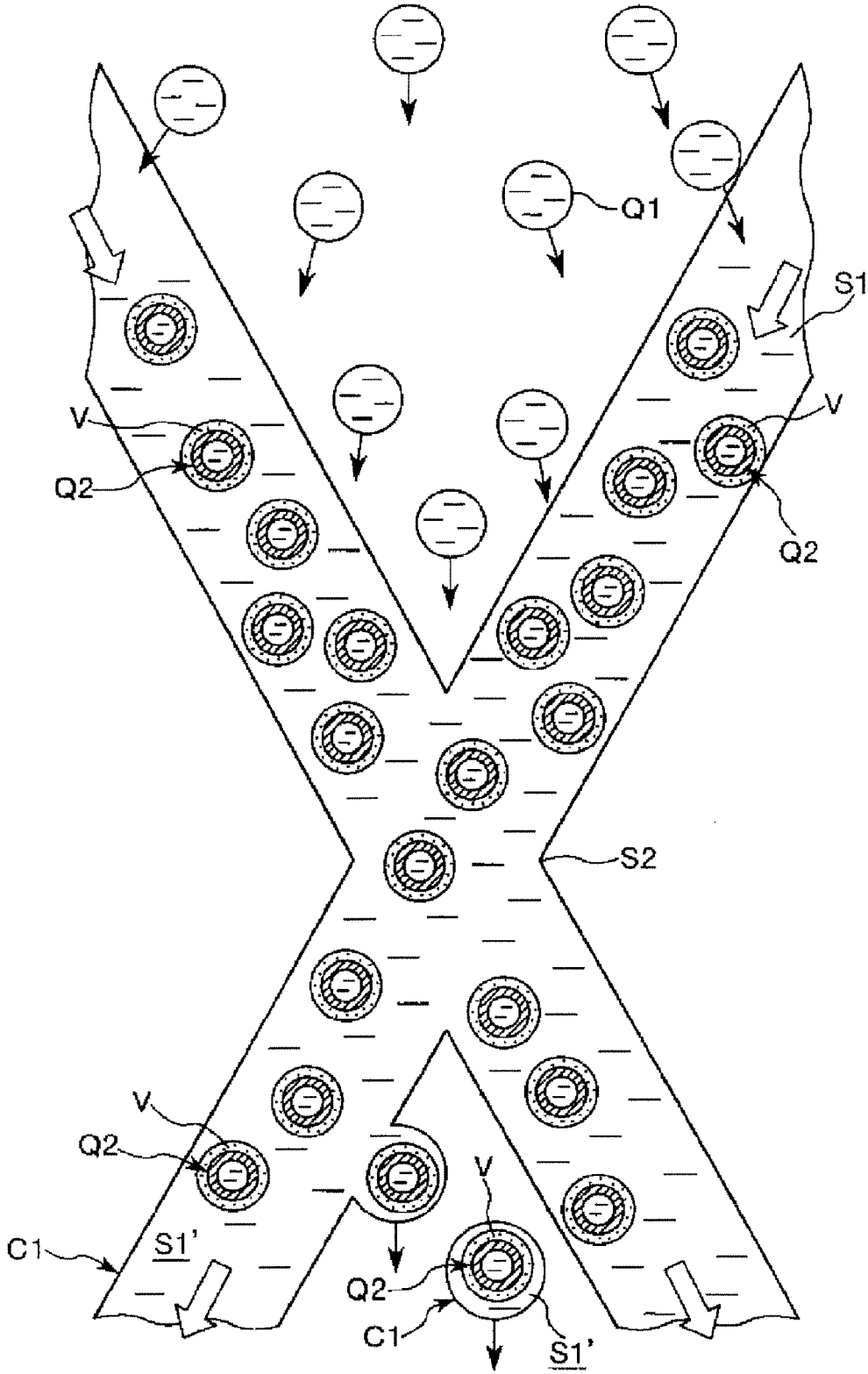
FIG. 3 is a magnified detail (schematic view) of a region B outlined with a double dashed line in FIG. 1.
Figure 4:
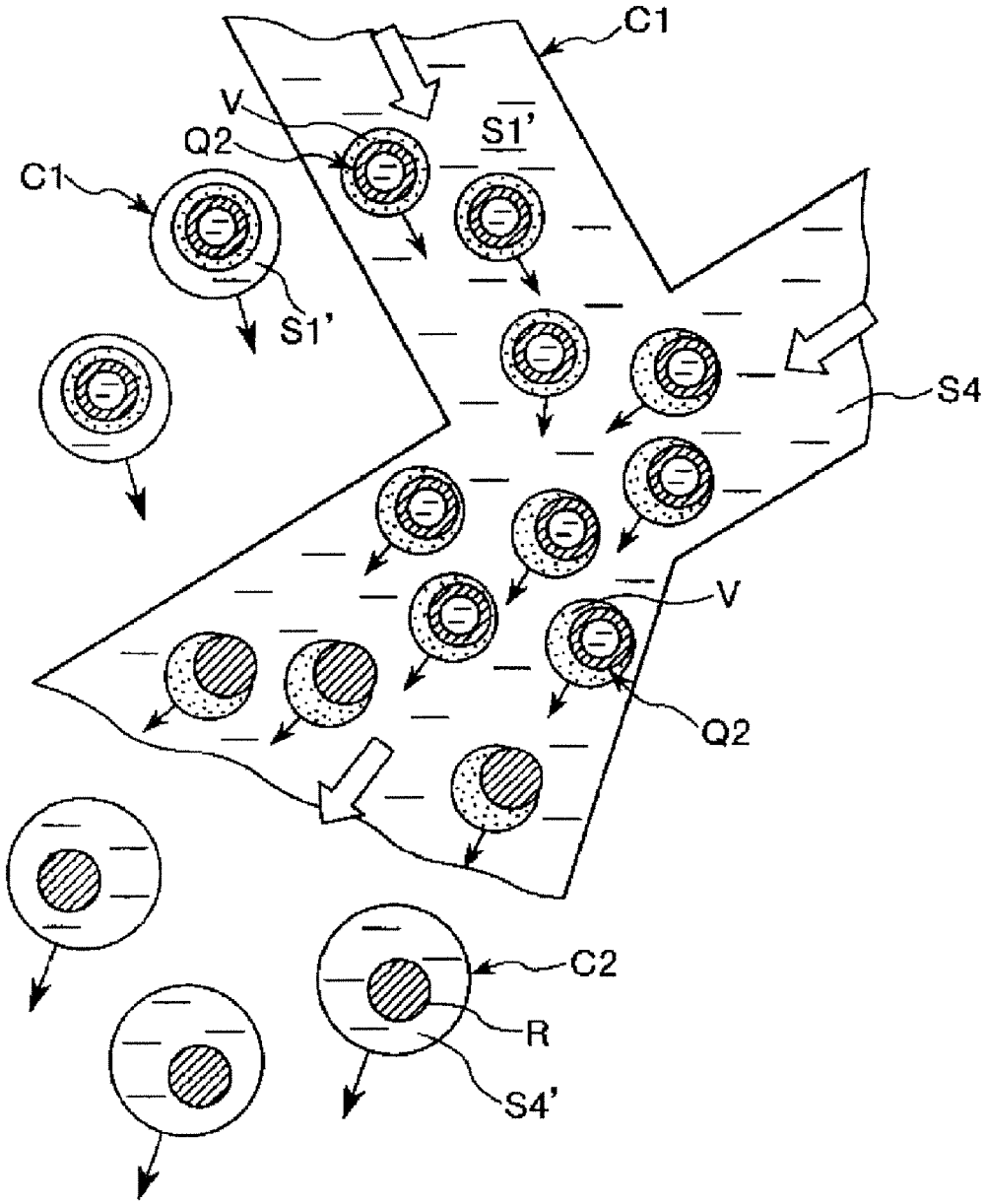
FIG. 4 is a magnified detail (schematic view) of a region C outlined with a chained line in FIG. 1.

FIG. 1 is a schematic view (longitudinal sectional view), illustrating the first embodiment of a device for manufacturing a metal powder according to one aspect of the invention. FIG. 2 is a magnified detail (schematic view) of a region A, outlined with a dashed line in FIG. 1. FIG. 3 is a magnified detail (schematic view) of a region B, outlined with a double dashed line in FIG. 1. Finally, FIG. 4 is a magnified detail (schematic view) of a region C, outlined with a chained line in FIG. 1. Hereafter, the top side of FIGS. 1 through 4 is defined as "top", and the bottom side thereof is defined as "bottom".

A metal powder manufacturing device (atomizer) 1 shown in FIG. 1 is used for powderization of molten metal Q using atomizing method, in order to obtain multiple particles of a metal powder R. This metal powder manufacturing device 1 includes a feeder (tundish) 2 that supplies the molten metal Q, a fluid spout unit 3 provided below the feeder 2, and a nozzle 6 and a cylinder 9A that are provided below the fluid spout unit 3.

The structures of the above components will now be described.

Referring to FIG. 1, the feeder 2 has a tubular portion with a bottom. The interior space (bore) 22 of the feeder 2 temporally contains the molten metal Q, and a raw material of the metal powder is melted into this molten metal Q.

The molten metal Q is obtained by melting a metallic material in a melting furnace such as a high-frequency induction furnace or a gas furnace. Here, the composition of the metallic material is such that a rapid cooling of the metal from a molten state results in an amorphous state.

Examples of the metallic materials whose compositions allow the amorphous state include: Fe-base alloys with bases such as Fe—Si—B, Fe—B, Fe—P—C, Fe—Co—Si—B, Fe—Si—B—Nb, and Fe—Zr—B; Ni-base alloys with bases such as Ni—Si—B, and Ni—P—B; and Co-base alloys with a base such as Co—Si—B.

An eject orifice 23 is provided in the center of a bottom 21 of the feeder 2. The molten metal Q contained in the interior space 22 is ejected downward by the gravity from the eject orifice 23.

The fluid spout unit 3 is provided below the feeder 2.

The fluid spout unit 3 includes a first channel 31 (a channel) and a second channel 32. The molten metal Q supplied (ejected) from the feeder 2 passes through the first channel 31, and a fluid (in this embodiment, a water 5) supplied from an un-illustrated fluid supply source passes through the second channel 32.

Referring now to FIGS. 1 and 2, the fluid spout unit 3 that includes the first channel 31 and the second channel 32 is formed of a first member 4 and a second member 5 being concentric to the first member 4, both of which assume a form of a disk (ring). The second member 5 is installed below the first member 4, having a gap 37 therebetween.

The first member 4 and the second member 5 together shape an orifice 34, an introduction channel 36, and a reservoir 35. In other words, the gap 37 formed between the first member 4 and the second member 5 constitutes the second channel 32.

The cross-section of the first channel 31 is circular, and the first channel 31 is formed at the center of the fluid spout unit 3, extending in the vertical direction.

The first channel 31 includes an internal-diameter-diminishing portion 33. The internal diameter of the fluid spout unit 3 gradually diminishes downward from the top surface 41, the spout thereof forming a convergent shape. This causes the flow of the water S spouting from the orifice 34 to pull the air (gas) G, existing above the fluid spout unit 3, toward the internal-diameter-diminishing portion 33. The pulled air G flows in a maximum velocity in a vicinity of a portion 331 where the internal diameter of the internal-diameter-diminishing portion 33 becomes the smallest (in other words, vicinity of the opening of the orifice 34). This flow of the air G causes the pressure (air pressure) of the first channel 31 from the top to the portion 331 to gradually decline.

The molten metal Q breaks and flies apart (primary breakup) when it passes through the low-pressure part of the first channel 31, as the surrounding pressure of the molten metal Q declines. This is because the congesting force working in the molten metal Q becomes weaker than the force caused by the level of the surrounding pressure. As a result, the molten metal Q breaks into multiple droplets Q1. Moreover, the resultant multiple droplets Q1 become spherical due to surface tension.

In this embodiment, the location of the lowest pressure is described to be in the vicinity of the portion 331 where the internal diameter of the internal-diameter-diminishing portion 33 is the smallest. However, the location of this region is not limited thereto, and may change in accordance with the shapes and angles of the internal-diameter-diminishing portion 33 or of the orifice 34.

Referring now to FIG. 2, the second channel 32 includes: the orifice 34 opened at the bottom end of the first channel 31 (vicinity of the portion 331); the reservoir 35 which temporally retains the water S; and the introduction channel 36 which introduces the water S from the reservoir 35 to the orifice 34.

The reservoir 35 is connected to the fluid supply source from which the water S is supplied. This reservoir 35 is formed so as to extend continuously to the orifice 34 through the introduction channel 36.

The longitudinal section of the introduction channel 36 assumes a shim shape. This allows a gradual increase in the flow velocity of the water S streaming in from the reservoir 35. At the same time, the water S stably spouts from the orifice 34 at an accelerated velocity.

The orifice 34 ejects (spouts), to the first channel 31, the water S which has passed through the reservoir 35 and then through the introduction channel 36.

The orifice 34 is opened as a slit that continues all around the inner surface of the first channel 31. At the same time, the orifice 34 is opened at an angle against a central axis O of the first channel 31. The water S ejected from the orifice 34 is therefore ejected in a shape such that a vertex S2 thereof points downward, and is approximately conical (refer to FIG. 1).

The droplets Q1 break and fly apart into finer particles (secondary breakup) when the droplets Q1 and the liquid jet S1 collide.

At the same time, the surface of the droplets Q1 is rapidly cooled down due to their contact with the liquid jet S1, and the vicinity of the surface of the droplets Q1 starts to solidify (harden). At this time, the liquid jet S1 partially evaporates, generating a vapor. The vapor is generated at the interface between the droplets Q1 and the liquid jet S1. Thus the generated vapor forms a vapor layer V so as to cover the surrounding of the droplets Q1 (refer to FIG. 3).

The formation of the vapor layer V causes the thermal conductivity between the droplets Q1 and the liquid jet S1 to decline. Thus, the droplets Q1 remains to be molten inside, since the cooling speed of the droplets Q1 is not sufficient in order for the droplets Q1 to be entirely solidified.

Consequently, the droplets Q1 turns to be in a semi-solid state (not entirely solidified), i.e., primary powder Q2, and the vapor layer V is generated surrounding the primary powder Q2.

Referring now to FIG. 3, the primary powder Q2 and the vapor layer V disperse throughout the mist S1' of the liquid jet S1, and thereafter drop downward as a dispersion liquid C1.

No particular limitation is imposed on the constituent materials for the first member 4 and the second member 5. Various metallic materials may be used. In particular, stainless steel is preferable.

The cylinder 9A is provided under the fluid spout unit 3, so that the top edge of the cylinder 9A abuts the bottom surface 51 of the fluid spout unit 3 (refer to FIG. 1).

The cylinder shown in FIG. 1 is a circular, and is provided so that it is concentric to the central axis O of the first channel 31.

The nozzle 6 is fixed on the outer circumference of the cylinder 9A, with the inner surface of the nozzle 6 being tightly attached to the outer surface of the cylinder 9A, forming a liquid-tight sealing therebetween (refer to FIG. 1).

The nozzle 6 shown in FIG. 1 includes a third channel 61 and a fourth channel 62. The droplets Q1 and the dispersion liquid C1 pass through the third channel 61, and a fluid (in this embodiment, a water S3) from an un-illustrated fluid supply source passes through the fourth channel 62.

Referring back to FIG. 1, the nozzle 6 that includes the third channel 61 and the fourth channel 62 is formed of a third member 7 and a fourth member 8 being concentric to the third member 7, both of which assume a form of a disk (ring). The fourth member 8 is installed below the third member 7, having a gap 67 therebetween.

The third member 7 and the fourth member 8 together shape an orifice 64, an introduction channel 66, and a reservoir 65. In other words, the gap 67 formed between the third member 7 and the fourth member 8 constitutes the fourth channel 62.

The nozzle 6 is arranged so that the third channel 61 becomes concentric to the central axis O of the first channel 31 of the fluid spout unit 3 described above.

The cross-section of the third channel 61 is circular, and is formed at the center of the nozzle 6, extending in the vertical direction.

Referring back to FIG. 1, the fourth channel 62 includes: the orifice 64 opening at the lower part of the third channel 61, the reservoir 65 which temporally retains the water S3; and the introduction channel 66 which introduces the water S3 from the reservoir 65 to the orifice 64.

The reservoir 65 is connected to the fluid supply source from which the water S3 is supplied.

This reservoir 65 is formed so as to extend continuously to the orifice 64 through the introduction channel 66.

The longitudinal section of the introduction channel 66 assumes a shim shape. This allows a gradual increase in the flow velocity of the water S3 streaming in from the reservoir 65. At the same time, the water S3 stably spouts from an ejection outlet 68 toward the third channel 61 through the orifice 64, at an accelerated velocity. Here, the ejection outlet 68 is installed on the wall of the cylinder 9A.

The orifice 64 ejects, to the third channel 61, the water S3 which has passed through the reservoir 65 and then through the introduction channel 66.

The orifice 64 is opened as a slit that continues all around the inner surface of the third channel 61. At the same time, the orifice 64 is opened at an angle against a central axis O of the first channel 31. The water S3 ejected from the orifice 64 is therefore ejected as a liquid jet S4 (a second fluid). The shape of the liquid jet S4 is such that a vertex thereof points downward, and is approximately conical (refer to FIG. 1). The orifice 64 is formed in a manner that the liquid jet S4 is ejected toward the dispersion liquid C1 and collides with it.

The course (direction of decent) of the dispersion liquid C1 is forcibly changed, pushed by the liquid jet S4, when the liquid jet S4 collides with the dispersion liquid C1 which contains the primary powder Q2 and the vapor layer V. That is to say, the nozzle 6 serves as a course modification unit in this embodiment, changing the traveling direction of the dispersion liquid C1.

The primary powder Q2 and the vapor layer V have significantly different specific gravities. Thus, their momentum, in other words, the size of the force necessary for changing the course of the moving object differs. Thus, the course of the primary powder Q2 differs slightly from that of the vapor layer V, if the liquid jet S4 applies a given force on them. As a result, the primary powder Q2 and the vapor layer V behave in a way that the vapor layer V breaks off from the primary powder Q2, being separated from each other.

Referring now to FIG. 4, if the vapor layer V is separated from the primary powder Q2, the surface of the primary powder Q2 directly contacts the liquid jet S4. The liquid jet S4 has the large heat capacity and the high heat transfer coefficient. The primary powder Q2 is therefore cooled down more efficiently. The primary powder Q2 in a semi-solid state fully solidifies, as the solidification progresses from its surface to the core. Consequently, the obtained metal powder R thereby maintains the amorphous state down to the core.

Referring now to FIG. 4, the metal powder R disperses throughout the mist S4' of the liquid jet S4, and thereafter drops downward as a dispersion liquid C2.

An un-illustrated container is provided below the metal powder manufacturing device 1. The dispersion liquid C2 is recovered into this container, and thereafter the metal powder R is recovered from the dispersion liquid C2.

Referring back to FIG. 1, the bottom edge of the cylinder 9A is located below the line of the bottom surface 81 of the nozzle 6. Therefore, the metal powder R is reliably recovered into the container, while preventing the dissipation of the metal powder R caused by the dispersal of the dispersion liquid C2.

The orifice 64 (nozzle 6) is formed so that the ejected liquid jet S4 assumes a conical shape, converging downward. This way, the liquid jet S4 is ejected covering the entire bore of the third channel 61, causing the liquid jet S4 to hit the dispersion liquid C1 without missing, thereby reliably changing the course of the dispersion liquid C1. Consequently, multiple particles of primary powder Q2 are cooled down evenly, providing a chemically homogeneous amorphous state, i.e., a disorder in the positions of atoms of the metal powder R being formed.

In this embodiment, the ejection outlet 68 ejecting the liquid jet S4 is provided on the wall of the cylinder 9A, i.e., on the inner surface of the third channel 61. Further, the liquid jet S4 hits the dispersion liquid C1 in the bore of the cylinder 9A. This allows the dispersion liquid C2 (metal powder R) to be recovered reliably, preventing the dissipation of the dispersion liquid C1 to undesired places upon hitting.

Referring back to FIG. 1, the top edge of the cylinder 9A abuts, or is appressed to, the bottom surface 51 of the fluid spout unit 3. This prevents gas to flow in from the top part of the cylinder 9A, causing the internal pressure of the third channel 61 to decline, as a result of the effect brought by the liquid jet S4. The pressure decline of the third channel 61 causes a decline of the internal pressure of the first channel 31 which is connected continuously to the third channel 61. This promotes the primary breakup in the first channel 31, accelerating a formation of fine particles. Consequently, droplets Q1 obtained in the primary breakup assume a finer form. At the same time, the secondary breakup the droplets Q1 undergo results in obtaining the primary powder Q2 in a finer form.

Here, the decline of pressure in the interior of the third channel 61 causes the decline of oxygen concentration in the ambient atmosphere. This suppresses the oxidation of the droplets Q1 as well as that of the primary powder Q2 in the semi-solid state. As a result, even if the droplets Q1 contain highly active elements such as aluminum and titanium, the oxidation of those elements can be suppressed, preventing a change in their composition. Thus, the amorphous state of those droplets is reliably obtained.

The time it takes for the primary powder Q2 to reach a total solidification, after the molten metal Q is ejected, is generally a very short period of less than 0.1 second. The metallic material in the droplets Q1 is in a liquid state, where there is no order in the positions of the atoms. Such atomic disorder is preserved within the droplets Q1, by cooling them down rapidly in a manner described above. This is because the time during which the droplets Q1 get solidified is shorter than the time required for the atoms to move so as to form a crystalline structure. Consequently, the metal powder R becomes an amorphous metal powder having atomic disorder therewithin.

Further, as described, the droplets Q1 become spherical due to surface tension. The particles of the metal powder R therefore also assume a shape of approximately a true sphere.

The metal powder manufacturing device 1 cools down a larger droplets Q1 in an efficient manner, while those larger droplets have larger heat capacity. The amorphous metal powder (metal powder R) containing larger particles is therefore obtained in an efficient manner.

Here, the cooling efficiency is particularly high since the liquid jet S4 constitutes a course modification unit. Therefore, the droplets Q1 are solidified with nearly no atoms forming the crystalline structure. As a result, the metal powder R in a highly amorphous state is obtained, practically without any fine crystalline structures contained therein.

The preferable timing for the dispersion liquid C1 to modify its course is prior to the time that the temperature of the primary powder Q2 in a semi-solid state drops down to the crystallization temperature of the molten metal Q. Here, the course modification entails the ejection of liquid jet S4 toward the primary powder Q2 and the vapor layer V. The crystallization of the primary powder Q2 is thereby securely prevented, reliably producing the amorphous metal powder (metal powder R).

The above timing is adequately measured by ejecting the liquid jet S4 below the vertex (convergent point) of the liquid jet S1 ejected in a shape of a cone, converging downward, as shown in FIG. 1. This prevents interference between the liquid jet S1 and the liquid jet S4, changing the course of the dispersion liquid C1 rapidly and sufficiently.

Here, it is preferable to eject the liquid jet S4 so that it hits the liquid jet S1 at the vicinity of the vertex S2 of the liquid jet S1. This reduces the time during which the primary powder Q2, formed by the second breakup which forms fine particles, is covered with the vapor layer V, so that the primary powder Q2 can be cooled rapidly. It is therefore possible to obtain the metal powder R in a highly amorphous state.

The location where the liquid jet S4 collides with the liquid jet S1 is preferably within 30 cm below the vertex S2 of the liquid jet S1, and particularly within 50 cm below the vertex S2. By ejecting the liquid jet S4 in the above range, the time the primary powder Q2 takes to be covered by the vapor layer V is shortened. It is therefore possible to obtain the metal powder R in a highly amorphous state.

The preferable ejection pressure of the liquid jet S4 (a second fluid) is approximately within a range of 5 to 40 MPa (50 to 400 kgf/cm$^2$). Particularly, a range approximately from 10 to 30 MPa (10 to 300 kgf/cm$^2$) is preferable. Consequently, the primary powder Q2 and the vapor layer V are separated in a high reliability. It is possible to increase the ejection pressure of the liquid jet above the upper limit. However, this is not desirable since the effect thereof would not be any stronger, and may result in a durability decline of the nozzle 6.

The preferable flow rate of the liquid jet S4 is approximately from 200 to 2000 L/min. Particularly, a range approximately from 300 to 1500 L/min is preferable. Consequently, the primary powder Q2 and the vapor layer V are separated in a high reliability.

Similar constituent materials as that of the first member 4 and the second member 5 may be used for the third member 7 and the fourth member 8. Stainless steel, in particular, is preferable.

The fluid spout unit 3 and the nozzle 6 may be in contact with each other, or may also be set away from each other. Other fluid may be used instead of the water S and the water S3.

One of the examples of the course modification unit is described above. Here, the liquid jet S4 changes the traveling direction of the dispersion liquid C1 containing the primary powder Q2 and the vapor layer V. However, the method of modification is not limited thereto.

In this embodiment, the usage of the liquid jet S4 allows an abrupt course change of the dispersion liquid C1 which contains the primary powder Q2 and the vapor layer V. Thus the separation between the primary powder Q2 and the vapor layer V is carried out in a reliable manner.

Further, the amorphous metal powder containing larger particles may also be obtained by increasing the flow velocity of the liquid jet S4, or by using a fluid with a higher heat capacity.

The nozzle 6 may also be provided as a plurality of nozzles 6, arranged in the vertical direction. Here, the intervals between the nozzles may change. However, it is preferable that the intervals are even.

Moreover, members assuming a form of a disk (ring), such as the third member 7 and the fourth member 8, are used for the nozzle 6 in this embodiment. However, the structure of the nozzle is not limited thereto, and may include a tubular member provided with an ejection outlet that ejects the liquid jet S4.

The metal powder R manufactured with this metal powder manufacturing device (the metal powder according to one embodiment of the invention) is in a highly amorphous state, even if the particle size thereof is relatively larger.

Amorphous metal is a metal in which there is an irregular atomic arrangement, and almost no crystalline structure and crystal grain boundary exists therewithin. Thus, compared to crystalline metal, it excels in hardness and toughness, since deformation caused by dislocation and breakage originating from the crystal grain boundary is less likely to occur.

Such characteristics contribute to the usage of the metal powder R as a powder that grinds the surface of a workpiece by hitting it. Due to its toughness and hardness, the metal powder R is not easily broken upon grinding, and thus can be used repetitively. Consequently, the grinding cost is reduced.

The grinding efficiency (grindability of a workpiece) of the metal powder R is proportional to the mass of the particles contained therein. This means that the metal powder R with a larger particle size particularly excels in grinding efficiency.

Moreover, if the molten metal Q contains magnetic metal, the metal powder R becomes soft magnetic. The soft magnetic grinding powder is easily magnetized even by a weak external field. As a result, the magnetic flux density of the magnetized grinding powder increases, allowing the sorting and recovery of the grinding powder using a magnetic force. Remanent magnetization of the recovered grinding powder becomes very weak after removing the external field flux. Thus the aggregation of particles is reliably prevented, making the particle suitable for repetitive usage.

A coercivity Hc of the metal powder R obtained in the above described manner is desirably 5[Oe] or less, in particular, 2[Oe] or less. As the level of amorphous property of the metal powder increases, the coercivity Hc thereof declines. Thus, the metal powder with very weak coercivity Hc is easily manufactured by the metal powder manufacturing device according to one aspect of the invention. Moreover, a grinding powder composed of such metal powder R with weak coercivity Hc hardly causes any aggregation after the recovery using the external field flux, since its remanent magnetization level is very small. This characteristic allows repetitive usage of the powder as a grinding powder.

The average particle size of such amorphous metal powder may preferably be between 5 and 20 μm inclusive, particularly, between 7 to 15 μm. If the average particle size is within the above range, contained therein is the extremely small sized amorphous metal powder with a diameter of less than 10 μm. Consequently, a metal powder which allows a grinding of, for instance, fine pattern is obtained at a low cost.

The metal powder composed of amorphous metal (hereafter referred to as "amorphous metal powder") is generally manufactured with, besides the above-described water atomizing, methods such as the spinning water atomization process (SWAP), the gas atomization process, and a grinding of a thin band with a rapidly cooling roll. However, except for water atomizing, such methods cannot manufacture an extremely small-sized amorphous metal powder with a diameter of less than 10 μm.

In contrast, the water atomizing is a method that allows the manufacturing of such extremely small sized amorphous metal powder with a diameter of less than 10 μm. This method exhibits high productivity, lowering the cost of the amorphous metal powder manufacturing. However, with the known water atomizing method, the metal powder having a diameter of 40 μm or more is less likely to become amorphous. Therefore, there has been a need to remove, by classification, the metal powder particles having a diameter of 40 μm or more, causing a cost increase due to the increase in the number of processes.

A granularity adjustment process such as classification is almost not necessary, even if the powder includes particles having a diameter of 40 to 60 μm, if the amorphous metal powder is manufactured with the above-described method using water atomizing. Therefore, the manufacturing cost of the amorphous metal powder is reduced, allowing to obtain the powder at a low cost. Such amorphous metal powder can easily be manufactured by using the metal powder manufacturing device according to the embodiment of the invention.

A method for manufacturing a molded body in which the metal powder R is shaped into a predetermined shape will now be described.

1. The metal powder R and an organic binder are mixed for obtaining a granulation powder.

No particular limitation is imposed on the mixing method. Examples of mixing method include the ones using various mixers such as a stirrer, a universal blender, a granulator, a ball mill, and a pressure kneader.

Examples of an organic binder include: polyolefins such as polyethylene, polypropylene, and ethylene-vinyl acetate copolymer; acrylic resins such as polymethyl methacrylate, and polybutyl methacrylate; styrene base resins such as polystyrene; epoxy base resins; silicone base resins; phenol base resins; polyesters such as polyvinyl chloride, polyvinylidene chloride, polyamide, polyethylene terephthalate, and polybuthylene terephthalate; polyethers; polyvinyl alcohols; various resins of those copolymers; various waxes such as paraffin; higher fatty acids such as stearic acid; higher alcohols; higher fatty acid esters; and higher fatty acid amides. These materials may be used alone or in combination of two or more.

The preferable content of the organic binder is approximately from 0.5 to 10 wt % of the entire granular powder, particularly, approximately from 1 to 8 wt %. If the content of the organic binder is within the above range, the molded body can be formed with an improved formability, increasing the density thereof, and improving the stability of the shape of the molded body. Moreover, the organic binder is spread throughout the metal powder in a reliable manner, so as to cover each of the particles thereof. Therefore, insulation between the particles improves, reducing the eddy-current loss, thereby exhibiting an excellent soft magnetism.

A plasticizer may also be added to the mixture. Examples of the plasticizer may include: phthalic esters such as DOP, DEP, and DBP; adipic acid esters; trimellitic esters; and sebacic acid esters. These materials may be used alone or in combination of two or more.

In addition to the components such as the metal powder R, the organic binder, and the plasticizer, various additives may be added to the mixture as needed. Examples of such additives include oxidation inhibitors, degreasing agents, and interfacial active agents.

The mixing condition varies according to other various conditions such as: the metallic composition and the particle size of the metal powder R being used; the composition of the organic binder; a blending quantity thereof; and the amount of diluting fluid. An example of the mixing condition is 20 to 40 minutes of mixing with a universal blender.

The mixture is processed into a granular powder by grinding the mixture after being dried or in the semi-dry state. An example of the particle size of the granular powder is approximately between 20 to 500 μm inclusive.

2. A molded body is obtained by shaping the prepared granular powder.

No particular limitation is imposed on the method for manufacturing a molded body (molding method). Examples include a metal injection molding (MIM) and a compression molding (powder compacting molding). The compression molding is particularly preferable.

A high pressure is imposed in the compression molding. Therefore the molding density is increased, thereby allowing a manufacturing of parts that exhibit an improved magnetic property, taking a full advantage of the characteristics of the metal powder R being used.

The manufacturing of a molded body produced by the compression molding will now be described.

The granular powder obtained as described above is filled into the mold, and is compressed and molded by sandwiching the powder with a punch, so as to manufacture a molded body of a desired shape. By selecting the suitable mold, a molded body of a complex shape may be manufactured with ease.

The preferable molding pressure is approximately from 0.1 to 2 GPa (1 to 20 ton/cm$^2$), particularly, approximately from 0.2 to 1 GPa (2 to 10 ton/cm$^2$).

Thereafter, the molded body is heated at a temperature between 50 to 200° C. inclusive, undergoing resin curing so as to be made into a magnetic core.

The molded body obtained thereby is in the state in which the organic binder is distributed approximately evenly on the surface of the metal powder. Here, the particles of the metal powder are insulated from each other by the organic binder. This means if the metal powder R in the molded body contains magnetic metal, the molded body exhibits an improved soft magnetic property. If, for instance, the molded body is used as a powder magnetic core, losses such as a hysteresis loss and a eddy-current loss are small upon its magnetization, and a magnetic permeability is high. Examples of a suitable application of such molded body includes cores of various power transformers, materials for various magnetic signal readers (magnetic head), and electromagnetic shields.

Second Embodiment

A second embodiment of a metal powder manufacturing device according to the present invention will now be described.

Figure 5:
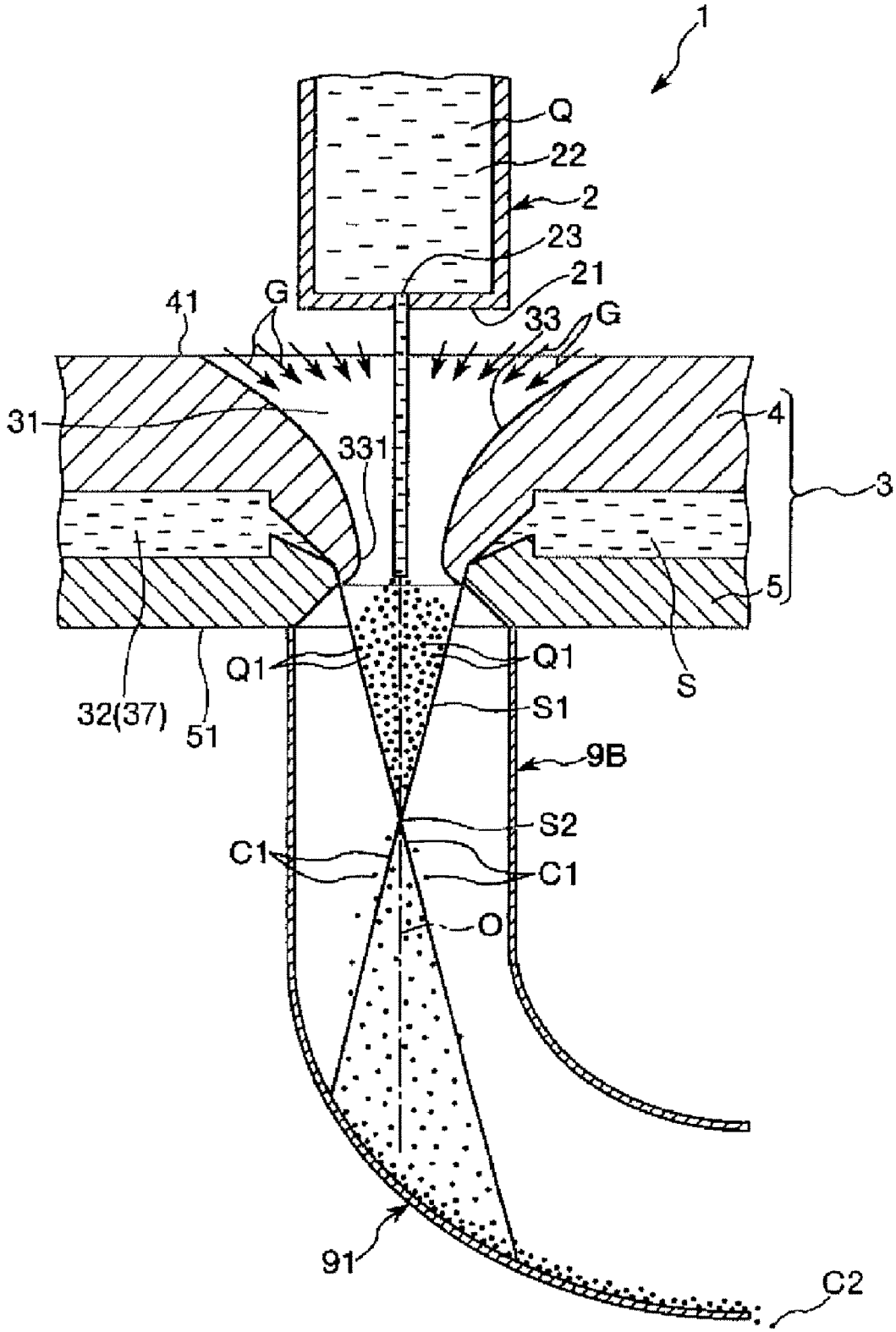
FIG. 5 is a schematic view (longitudinal sectional view) illustrating another embodiment of a device for manufacturing a metal powder according to one aspect of the invention.

FIG. 5 is a schematic view (longitudinal sectional view) illustrating the second embodiment of a device for manufacturing a metal powder according to the invention. Hereafter, the top side of FIG. 5 is defined as "top", and the bottom side thereof is defined as "bottom".

Descriptions of the items overlapping the first embodiment will be omitted in the explanation of the second embodiment, and the differences between them will mainly be described.

The metal powder manufacturing device 1 according to the second embodiment is similar to that of the first embodiment, except for the difference in the structure of the course modification unit.

The cylinder 9B is a tubular member whose top and bottom ends are open, installed so that it abuts the bottom surface 51 of the fluid spout unit 3.

The top opening of the cylinder 9B is arranged so that it becomes concentric to the fluid spout unit 3. At the same time, the bottom opening of the cylinder 9B is facing sideways (the right side of FIG. 5), being out of alignment from the central axis O of the first channel 31. The cylinder 9B has a curved (or bent) curvature 91 in the middle of its longitudinal direction.

An un-illustrated container is provided below the bottom opening of the cylinder 9B.

When the dispersion liquid C1 passes through the curvature 91 of the cylinder 9B, the course (direction of decent) thereof is forcibly changed at the curvature 91, so as to be along the internal wall of the cylinder 9B. Here, the dispersion liquid C1 is composed of the primary powder and the vapor layer dispersed into the mist of the liquid jet S1. That is to say, the cylinder 9B serves as a course modification unit, changing the traveling direction of the dispersion liquid C1. As a result, the primary powder and the vapor layer behave in a way so that they are separated from each other, caused by a centrifugal force working on the dispersion liquid C1.

Here, the direct contact of the primary powder with the mist of the liquid jet S1 causes the powder to cool down more efficiently. Ultimately, the semi-solid primary powder Q2 solidifies entirely, as the solidification progresses from its surface to the core. The metal powder is thereby obtained easily. Referring back to FIG. 5, the metal powder disperses throughout the mist of the liquid jet S1, and thereafter drops downward as the dispersion liquid C2. The dispersion liquid C2 is thereafter recovered into the container, and thereafter the metal powder is recovered from the dispersion liquid C2.

Therefore, the similar outcome and effect as in the first embodiment can be obtained in the second embodiment of the metal powder manufacturing device.

Third Embodiment

A third embodiment of a metal powder manufacturing device according to the present invention will now be described.

Figure 6:
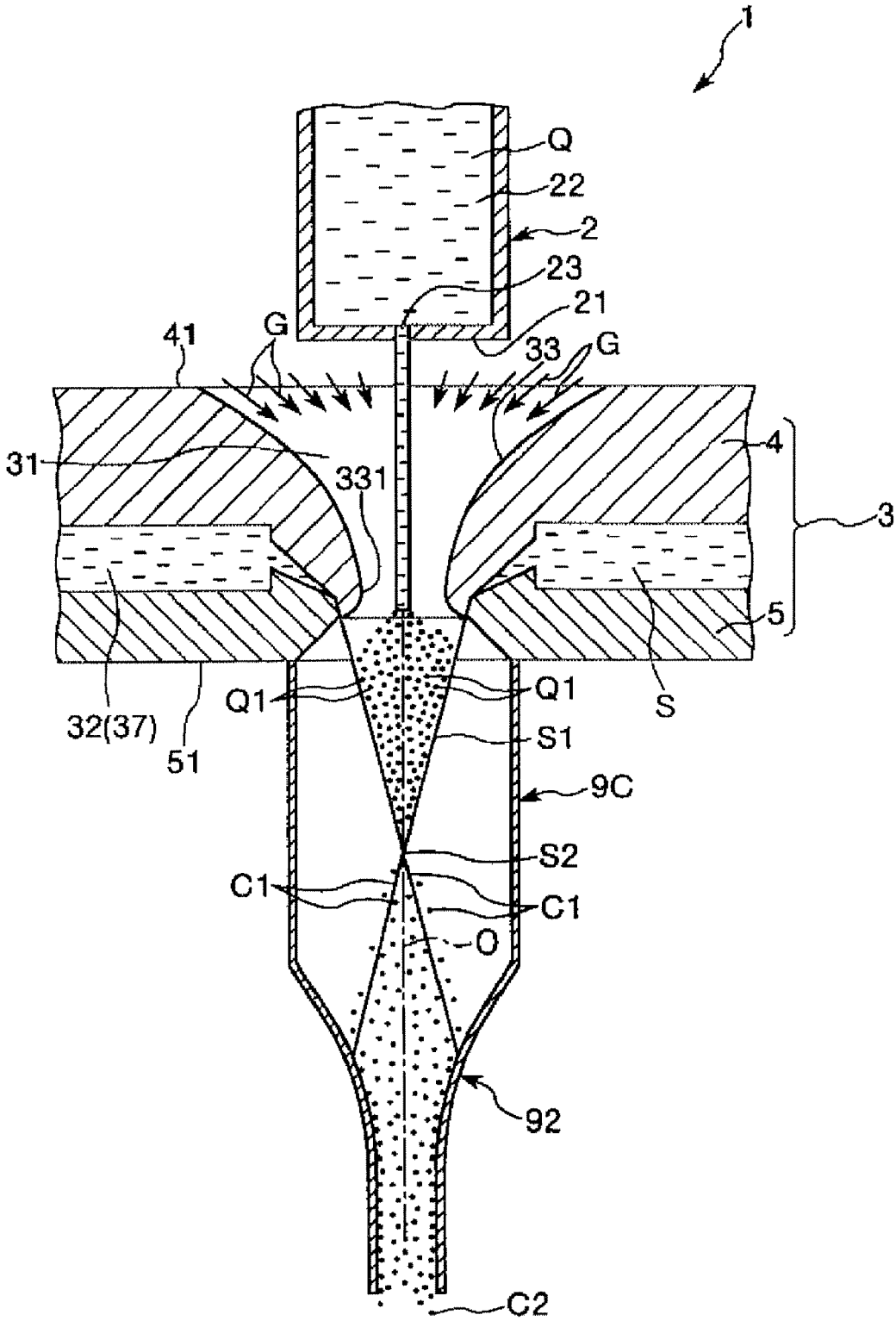
FIG. 6 is a schematic view (longitudinal sectional view) illustrating another embodiment of a device for manufacturing a metal powder according to one aspect of the invention.

FIG. 6 is a schematic view (longitudinal sectional view) illustrating the third embodiment of a device for manufacturing a metal powder according to the invention. Hereafter, the top side of FIG. 6 is defined as "top", and the bottom side thereof is defined as "bottom".

Descriptions of the items overlapping the first embodiment will be omitted in the explanation of the third embodiment, and the differences between them will mainly be described.

The metal powder manufacturing device 1 according to the second embodiment is similar to that of the first embodiment, except for the difference in the structure of the course modification unit.

The cylinder 9C is a tubular member whose top and bottom ends are open, installed so as to abut the bottom surface 51 of the fluid spout unit 3.

The cylinder 9C has a narrow portion 92 in the middle of its longitudinal direction, where the internal diameter becomes smaller as it continues downward.

When the dispersion liquid C1 passes through the narrow portion 92 of the cylinder 9C, the course (direction of decent) thereof is forcibly changed at the narrow portion 92 while passing therethrough, so as to be along the internal wall of the cylinder 9C. Here, the dispersion liquid C1 is composed of the primary powder and the vapor layer dispersed into the mist of the liquid jet S1. That is to say, the cylinder 9C serves as a course modification unit, changing the traveling direction of the dispersion liquid C1. As a result, similar to the first and the second embodiments, the primary powder and the vapor layer behave in a way so that they are separated from each other.

The direct contact of the primary powder with the mist of the liquid jet S1 causes the powder to cool down more efficiently. Ultimately, the semi-solid primary powder Q2 solidifies entirely, as the solidification progresses from its surface to the core. The metal powder is thereby obtained. Referring back to FIG. 6, the metal powder disperses throughout the mist of the liquid jet S1, and thereafter drops downward as the dispersion liquid C2. The dispersion liquid C2 is thereafter recovered into the container, and thereafter the metal powder R is recovered from the dispersion liquid C2.

In the third embodiment, the internal diameter of the cylinder 9C gradually diminishes downward. Thus the interior of the cylinder 9C is likely to be clogged with the dispersion liquid C1 when it passes through the cylinder 9C. The pressure is reduced in the interior of the cylinder 9C and of the first channel 31 connected continuously thereto, thereby promoting the formation of fine particles in the primary breakup. Thus, the droplets Q1 formed into finer particles are obtained in the primary breakup.

Here, oxygen concentration in the ambient atmosphere declines, along with the decline of pressure in the interior of the cylinder 9C and of the first channel 31 connected continuously thereto. This suppresses, as described, the oxidation of the droplets Q1 as well as that of the primary powder in the semi-solid state. As a result, even if the droplets Q1 contain highly active elements such as aluminum and titanium, the oxidation of those elements can be suppressed, preventing a change in their composition. Thus, the amorphous metal powder is manufactured reliably.

Consequently, the similar outcome and effect as in the first and the second embodiments can be obtained in the third embodiment of the metal powder manufacturing device.

Fourth Embodiment

A forth embodiment of a metal powder manufacturing device according to the present invention will now be described.

Figure 7:
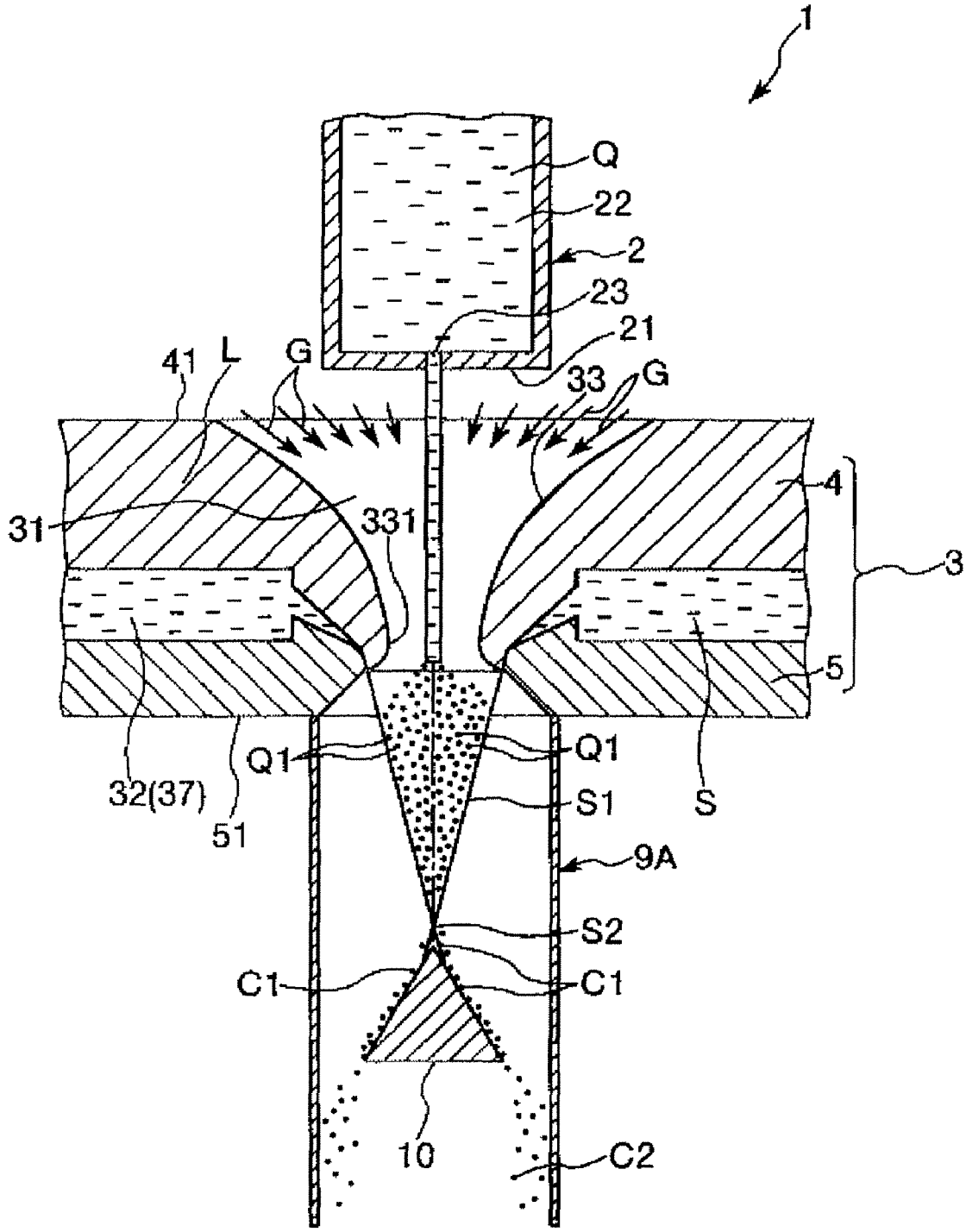
FIG. 7 is a schematic view (longitudinal sectional view) illustrating still another embodiment of a device for manufacturing a metal powder according to one aspect of the invention.

FIG. 7 is a schematic view (longitudinal sectional view) illustrating the fourth embodiment of a device for manufacturing metal powder according to the invention. Hereafter, the top side of FIG. 7 is defined as "top", and the bottom side thereof is defined as "bottom".

Descriptions of the items overlapping the first embodiment will be omitted in the explanation of the fourth embodiment, and the differences between them will mainly be described.

The metal powder manufacturing device 1 according to the second embodiment is similar to that of the first embodiment, except for the difference in the structure of the course modification unit.

In the fourth embodiment, a block 10 is provided below the fluid spout unit 3.

This block 10 assumes a shape of a cone, and the vertex thereof is positioned on the central axis O of the fluid spout unit 3.

When the dispersion liquid C1 is dropped and hits the side surface of such block 10, the course (direction of decent) of the dispersion liquid C1 is forcibly changed, being flipped by the side surface of the block 10. Here, the dispersion liquid C1 is composed of the primary powder and the vapor layer dispersed into the mist of the liquid jet S1. That is to say, the block 10 serves as a course modification unit, changing the traveling direction of the dispersion liquid C1. As a result, similar to the first through third embodiments, the primary powder and the vapor layer behave in a way so that they are separated from each other.

The direct contact of the primary powder with the mist of the liquid jet S1 causes the powder to cool down more efficiently. Ultimately, the semi-solid primary powder Q2 solidifies entirely, as the solidification progresses from its surface to the core. The metal powder is thereby obtained with particular ease. Referring back to FIG. 7, the metal powder disperses throughout the mist of the liquid jet S1, and thereafter drops downward as the dispersion liquid C2. The dispersion liquid C2 is thereafter recovered into the container, and thereafter the metal powder is recovered from the dispersion liquid C2.

Consequently, the similar outcome and effect as in the first through second embodiments can be obtained in the fourth embodiment of the metal powder manufacturing device.

The block 10 may have a shape other than a cone. Examples of such shapes include a pyramid, a sphere, a cuboid, and a cube.

As described above, the embodiments of the metal powder manufacturing device as well as the embodiments of the metal powder in this invention are explained with reference to the drawings. However, the invention is not limited thereto. Components constituting the metal powder manufacturing device may be altered with any member that achieves a functionality similar to that of the constituting components. Moreover, optional constituents may also be added to the device.

Further, the structure of the cylindrical body may also be a combination of the structures described in the embodiments.

EXAMPLES

Manufacturing Metal Powder and Powder Magnetic Core

First Example

1. Raw materials of the following elements with the following mass content were weighed and melted in a high-frequency induction furnace so as to obtain the molten material.

Mass Content of Constituent Elements
Si: 13 atm %
B: 14 atm %
C: 2 atm %
Cr: 2 atm %
Fe: the rest 2. The obtained molten material was formed into a powder using the atomizer (metal powder manufacturing device according to the first embodiment of the invention) shown in FIG. 1, thereby obtaining a metal powder.

3. A bulk powder contained in this metal powder was screened out and removed using a bolter with a standard 65 μm screen. The resultant metal powder and an epoxy resin (organic binder) were weighted to have a ratio of 98:2 by mass.

4. The epoxy resin was fed into a universal blender, and isopropyl alcohol (IPA) was added as a dilute solution. After the mix was stirred and the resin was dissolved, the metal powder was fed and stirred for 30 minutes, thereby obtaining a mixture.

5. After this mixture was dried, it was ground with a ball mill, and then granulated with a standard 500 μm screen. The resultant mixture was compressed and molded with a molding pressure of 1.5 GPa, and 10 molded bodies were prepared.

6. The molded bodies were heated at 170° C. for one hour, undergoing resin curing so as to be made into a magnetic core.

Molding Conditions
Specimen size: 28 mm (outer diameter), 14 mm (inner diameter), and 5 mm (thickness)
Molding pressure: 1.5 GPa (15 ton/cm$^2$)

Comparative Example

Ten molded bodies were prepared using a metal powder obtained in the same manner as that of the first example, except for using an atomizer without the nozzle (course modification unit).

2. Evaluation of Metal Powder and Powder Magnetic Core

A crystal structure analysis of the metal powders obtained by the first example and by the comparative example was carried out using X-ray diffraction.

The metal powders were screened and classified into six levels by particle size, and the crystal structure analysis was carried out on each of them. The six different levels of particle size include: less than 20 μm; from 20 μm or more to less than 35 μm; from 35 μm or more to less than 45 μm; from 45 μm or more to less than 65 μm; from 65 μm or more to less than 75 μm; and 70 μm or more.

Based on the spectrum obtained with the X-ray diffraction of the powder in each level, the amorphous state of the powder in each level was evaluated. The evaluation criteria were as follows.

Excellent: Amorphous state without crystal peaks.
Good: Some crystal peaks were recognized, and some crystalline particles were mixed into the powder.
Intermediate: Many crystal peaks were recognized, and many crystalline particles were mixed into the powder.
Bad: Crystal peaks were clearly observed, and the powder is approximately crystalline.

Thereafter, a bulk powder contained therein was screened out and removed using a bolter with a standard 65 μm screen. The particle size was then measured with a laser particle size distribution analyzer "Microtrac®", and a coercivity Hc is measured with a vibrating sample magnetometer (VSM) by Tamagawa Works Co.

Subsequently, magnetic permeability measurement and an evaluation of a core loss characteristic were carried out using both sets of ten molded bodies obtained in the first example and the comparative example, using an impedance grain analyzer 4194A by Hewlett-Packard and a BH analyzer SY8232 by Iwasu Test Instruments Corporation.

The results of the evaluation are listed in Table 1.

TABLE 1

| | Metal Powder | | | | | | | |
|---|---|---|---|---|---|---|---|---|
| | Crystal Structure Analysis of Different Particle Sizes | | | | | | Coercivity | Average Particle Size |
| | 1 | 2 | 3 | 4 | 5 | 6 | Hc [Oe] | [μm] |
| Example | Excellent | Excellent | Excellent | Excellent | Good | Intermediate | 1.5 | 10.4 |
| Comparative Example | Good | Good | Intermediate | Bad | Bad | Bad | 7.5 | 10.2 |

1 Particle size of less than 20 μm
2 Particle size of 20 μm or more to less than 35 μm
3 Particle size of 35 μm or more to less than 45 μm
4 Particle size of 45 μm or more to less than 65 μm
5 Particle size of 65 μm or more to less than 75 μm
6 Particle size of 70 μm or more The spectrum of the X-ray diffraction of the metal powder obtained in the first example did not exhibit a sharp crystalline peak. This means that even relatively large-sized particles are composed of amorphous metal. The powder obtained in the first example also exhibited an improved soft magnetic property, having a significantly low coercivity.

In contrast, the spectrum of the X-ray diffraction of the metal powder obtained in the comparative example exhibited peaks in the particles equal to or larger than 35 μm. This leads to the assumption that large-sized particles include crystalline metal. Moreover, the particles obtained in the comparative example had a relatively large coercivity.

For both the first example and the comparative example, the average particle size of the powder screened out using a standard 65 μm screen were very fine, approximately 10 μm on average.

The powder obtained in the first example exhibited favorable magnetic core characteristics, such as high magnetic permeability and low core loss.

Other metal powders were obtained using the metal powder manufacturing devices referred to in FIGS. 5 to 7, in a manner similar to the first example, and molded bodies were prepared using those metal powders. Similar evaluations were carried out on the metal powders and the molded bodies obtained, producing results similar to those of the first example.

What is claimed is:

1. A method for manufacturing a metal powder, comprising:

supplying a molten metal to a fluid spout unit including a channel such that the molten metal passes through the channel;

spouting a fluid into the channel to contact the molten metal using an orifice opened at a bottom end of the channel to form a dispersion liquid composed of multiple fine particles dispersed in the fluid that result from a breakup caused by contact between the fluid and the molten metal, each particle dispersed in the fluid having a vapor layer disposed thereon;

passing the dispersion liquid through a cylinder having an axis located downstream from the fluid spout unit that encircles the dispersion liquid, the cylinder narrowing radially inwardly toward the axis around an entire circumference of the cylinder via a radius of curvature that extends in a longitudinal direction of the cylinder such that the cylinder has a smaller diameter in a middle of the longitudinal direction thereof; and changing a traveling direction of the dispersion liquid by contacting the dispersion liquid with the radius of curvature of the cylinder to form the metal powder, contact between the dispersion liquid and the radius of curvature of the cylinder separating the vapor layer from each of the particles using a centrifugal force.

2. The method of claim 1, wherein the metal powder has a particle size between 5 and 20 μm, inclusive.

3. The method of claim 1, wherein the metal powder is a Fe-based alloy.

4. The method of claim 1, wherein the metal powder is a Ni-based alloy.

5. The method of claim 1, wherein the metal powder is a Co-based alloy.

6. The method of claim 1, wherein the metal powder is one selected from the group consisting of an Fe—Si—B alloy, an Fe—B alloy, a Fe—P—C alloy, a Fe—Co—Si—B alloy, a Fe—Si—B—Nb alloy, a Fe—Zr—B alloy, a Ni—Si—B alloy, a Ni—P—B alloy, and a Co—Si—B alloy.

7. The method of claim 1, wherein the fluid is spouted by the orifice as a conical-shaped stream.

8. The method of claim 7, wherein the conical-shaped stream intersects at a point upstream from the radius of curvature.

9. The method of claim 1, wherein the molten metal undergoes an initial breakup after passing through the channel and prior to contact with the fluid.

10. The method of claim 1, wherein the metal powder is amorphous.

* * * * *